US011566408B2

(12) United States Patent
Paar

(10) Patent No.: US 11,566,408 B2
(45) Date of Patent: Jan. 31, 2023

(54) SINK CLOG REMOVAL DEVICE

(71) Applicant: Michael J. Paar, Mesa, AZ (US)

(72) Inventor: Michael J. Paar, Mesa, AZ (US)

( * ) Notice: Subject to any disclaimer, the term of this patent is extended or adjusted under 35 U.S.C. 154(b) by 71 days.

(21) Appl. No.: 17/064,982

(22) Filed: Oct. 7, 2020

(65) Prior Publication Data

US 2022/0106780 A1 Apr. 7, 2022

(51) Int. Cl.
*E03C 1/306* (2006.01)
*E03C 1/302* (2006.01)

(52) U.S. Cl.
CPC ..... *E03C 1/306* (2013.01); *E03C 1/302* (2013.01)

(58) Field of Classification Search
CPC . E03C 1/306; F16L 33/00; F16L 33/02; F16L 33/224; F16L 33/003; F16L 3/123; F16L 3/1233; F16L 3/13; F16L 7/00; B08B 9/032
USPC ..... 4/255.06
See application file for complete search history.

(56) References Cited

U.S. PATENT DOCUMENTS 473,716 A * 4/1892 Stevens ..... A62C 31/28 248/77
895,955 A * 8/1908 Brown ..... E03C 1/306 134/93
1,493,498 A * 5/1924 Pluym ..... A01G 25/00 68/207
1,558,161 A * 10/1925 Gunderson ..... E03C 1/306 4/255.06
1,665,029 A * 4/1928 Hartnett ..... E03C 1/306 4/255.09
1,796,340 A * 3/1931 Nowakowski ..... E03C 1/306 15/104.33
1,925,359 A * 9/1933 Alonso ..... E03C 1/306 285/8
2,016,498 A * 10/1935 Hopewell ..... E03C 1/306 4/255.07
2,024,873 A * 12/1935 Perry ..... E03C 1/306 285/191
2,177,566 A * 10/1939 Horwitz ..... E03C 1/306 285/191
2,233,378 A * 2/1941 Wilson ..... E03C 1/306 4/255.05
2,390,750 A * 12/1945 Tinnerman ..... F16B 2/005 24/562
2,430,739 A * 11/1947 Scott ..... E03C 1/306 285/259

(Continued)

*Primary Examiner* — Benjamin R Shaw
(74) *Attorney, Agent, or Firm* — Schmeiser Olsen & Watts, LLP

(57) ABSTRACT

A sink drain clog removal device is provided. The sink drain clog removal device may include a nozzle coupled to a U-shaped clamping member, the clamping member having an upper arm and a lower arm. The clamping member is configured to fit over the lip of a sink drain pipe such that the nozzle is directed into the drain pipe. The clamping member may be secured to the drain pipe by a clamping screw. The nozzle has a hose connector for connecting to a water supply hose. The water supply hose may be connected to a water supply valve. The water supply valve is used to control water flow through the hose and through the nozzle to direct water into the sink drain pipe while unclogging the drain pipe. A method of using a sink drain clog removal device is also disclosed.

10 Claims, 5 Drawing Sheets

(56) References Cited

U.S. PATENT DOCUMENTS 2,430,976 A * 11/1947 Dutra ..... E03C 1/306 451/75
2,436,634 A * 2/1948 Davis ..... E03C 1/306 285/8
2,461,656 A * 2/1949 Norman ..... E03C 1/306 285/8
2,500,404 A * 3/1950 Donnelly ..... E03C 1/306 285/8
3,301,513 A * 1/1967 Sugaya ..... F16L 3/24 248/228.6
3,747,166 A * 7/1973 Eross ..... F16L 3/24 403/188
3,937,404 A * 2/1976 Johnson ..... B08B 9/0322 4/255.09
4,144,598 A * 3/1979 Li ..... E03C 1/308 4/255.06
4,756,480 A * 7/1988 Fish ..... E03C 1/306 4/255.09
4,903,929 A * 2/1990 Hoffman ..... B25B 5/101 248/229.15
5,018,260 A * 5/1991 Ziu ..... F16L 9/18 138/108
5,682,620 A * 11/1997 Stoltz ..... B08B 9/045 15/104.33
6,098,212 A * 8/2000 Rogan ..... E03C 1/306 15/104.33
6,185,755 B1 * 2/2001 Shepherd ..... E03C 1/306 251/324
6,295,659 B1 * 10/2001 Sandness ..... E03C 1/306 4/255.09
6,941,589 B1 * 9/2005 Dural ..... E03C 1/306 4/255.06
11,137,003 B1 * 10/2021 Callahan ..... F16B 2/22
2016/0168833 A1 * 6/2016 Palmer, II ..... E03C 1/306 4/255.06
2016/0208838 A1 * 7/2016 Allmon ..... F16B 2/065
2016/0258148 A1 * 9/2016 Pant ..... B08B 9/0321
2016/0305104 A1 * 10/2016 Paar ..... E03D 13/005
2019/0136640 A1 * 5/2019 Nitsche ..... E21B 47/12
2020/0063898 A1 * 2/2020 Ohnemus ..... F16L 3/1091
2021/0140564 A1 * 5/2021 Ruberto ..... F16L 3/003
2021/0172545 A1 * 6/2021 Kennedy, III ..... F16L 57/005
2021/0285572 A1 * 9/2021 Ohnemus ..... F16L 3/16

* cited by examiner

SINK CLOG REMOVAL DEVICE

BACKGROUND OF THE INVENTION

Technical Field

This invention relates generally to plumbing clog removal device and more particularly to a sink clog removal device.

State of the Art

Sinks are common plumbing fixtures used for washing hands, dishwashing, and other purposes. Sinks include a drain to remove used water. Sink drains are susceptible to clogs that inhibit proper function of the fixture. They can often be unclogged using a plumbing cable, which is often performed after disconnecting the drain from the sink.

When using the plumbing cable, it is often desirable to use a hose to direct water into the sink drain and send the clog through the pipes to a sanitary sewer. Further, the water may be used to clean the plumbing cable during use. The hose could be connected to the water supply of the sink at the angle stop. However, using a hose in such a manner is not practical, as it requires the plumber to hold the hose with one hand while unclogging the drain with the other. This will inevitably lead to unwanted spraying of water into the cabinet in addition to the impracticality of unclogging the drain with one hand.

Another conventional device used for directing water into a clogged sink drain is a bladder with a hose attached. In operation, the bladder is inserted into the drain pipe with a nozzle directed into the drain pipe. The bladder is filled with water, thus pressurizing the bladder and sealing off the drain pipe. The pressurized bladder thereby injects water through the nozzle and into the drain pipe with the intention of unclogging the blockage in the drain pipe. However, the water stream is often sprayed with insufficient force to unclog the drain, and the bladder seals off the drain pipe, thereby preventing the insertion and use of a plumbing cable to unclog the blockage.

Accordingly, there is a need in the field of plumbing clog removal devices for an improved sink clog removal device.

SUMMARY OF THE INVENTION

The present invention relates to a sink clog removal device, wherein the device couples to a sink drain pipe and further couples to a hose to direct water into the sink drain pipe. Further, the device includes an aperture for extending a plumbing cable therethrough and into the sink drain pipe.

An embodiment may include a dink drain clog removal device comprising a drain pipe connecting member configured to couple to a sink drain pipe; and a hose coupled on a first end to the drain pipe connecting member, wherein the drain pipe connecting member comprises a hose connector to direct water into the sink drain pipe.

Another embodiment may include a method of removing a clog in a sink drain, the method comprising removably coupling a sink drain clog removal device to a sink drain pipe; coupling a hose to the sink drain clog removal device; extending a plumbing cable into the sink drain pipe to unclog the sink drain pipe; and directing water through the hose and into the sink drain pipe to direct material unclogged through the pipes.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to a sink drain clog removal device, wherein the device couples to a sink drain pipe and further couples to a hose to direct water into the sink drain pipe.

Embodiments of the present invention have been provided to allow a plumber to unclog a sink drain pipe more easily. The sink drain clog removal device allows a plumber to use both hands to operate the plumbing cable to break up the clog and further to have direct control over the flow of water into the sink drain pipe.

Figure 1:
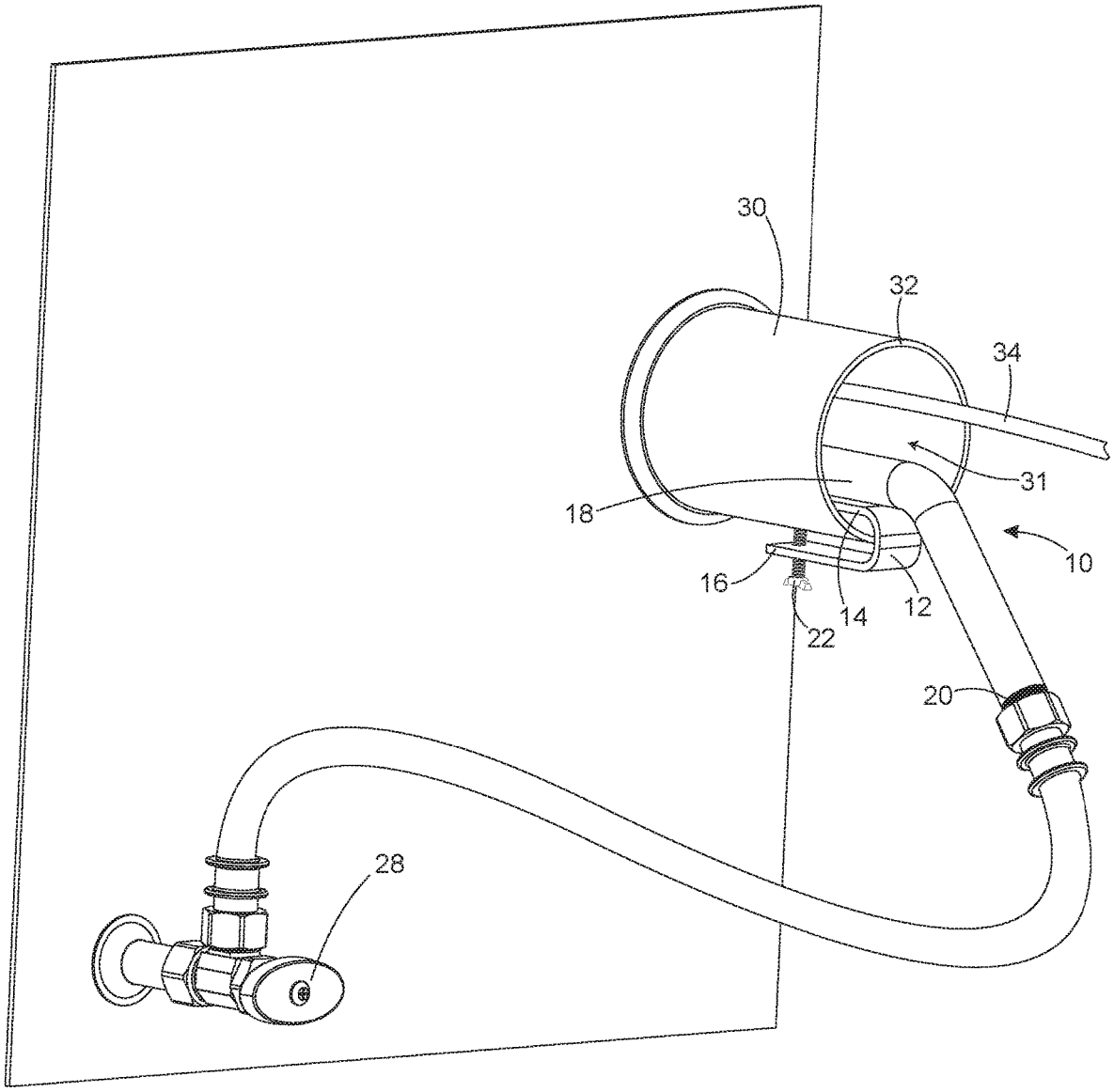
FIG. 1 is a perspective view of a sink drain clog removal device, according to an embodiment.

Referring to the drawings, FIG. 1 depicts a perspective view of an embodiment of a sink drain clog removal device 10. The sink drain clog removal device 10 may comprise a clamping member 12, a nozzle 18, a hose 26 and a valve 28.

Figure 2:
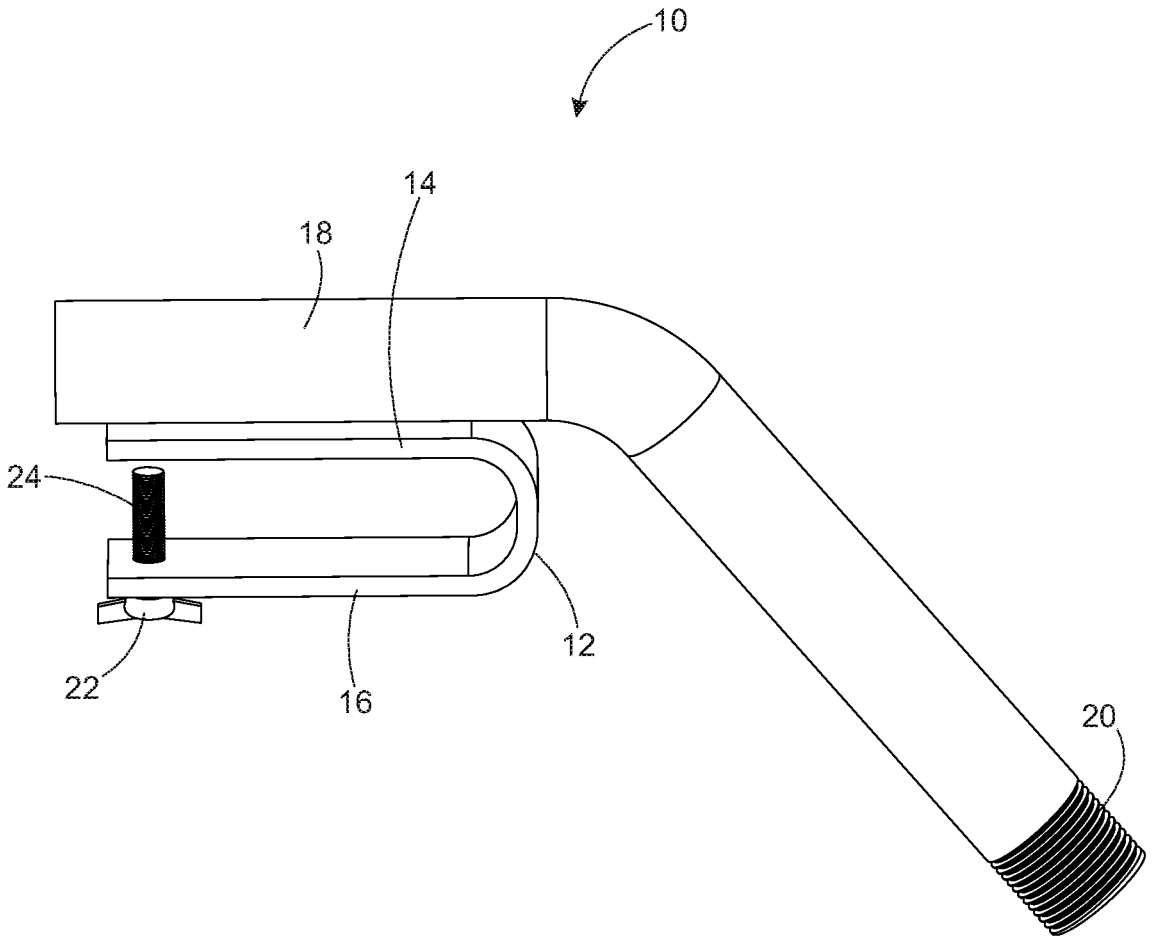
FIG. 2 is a front perspective view of a sink drain clog removal device, according to an embodiment.
Figure 3:
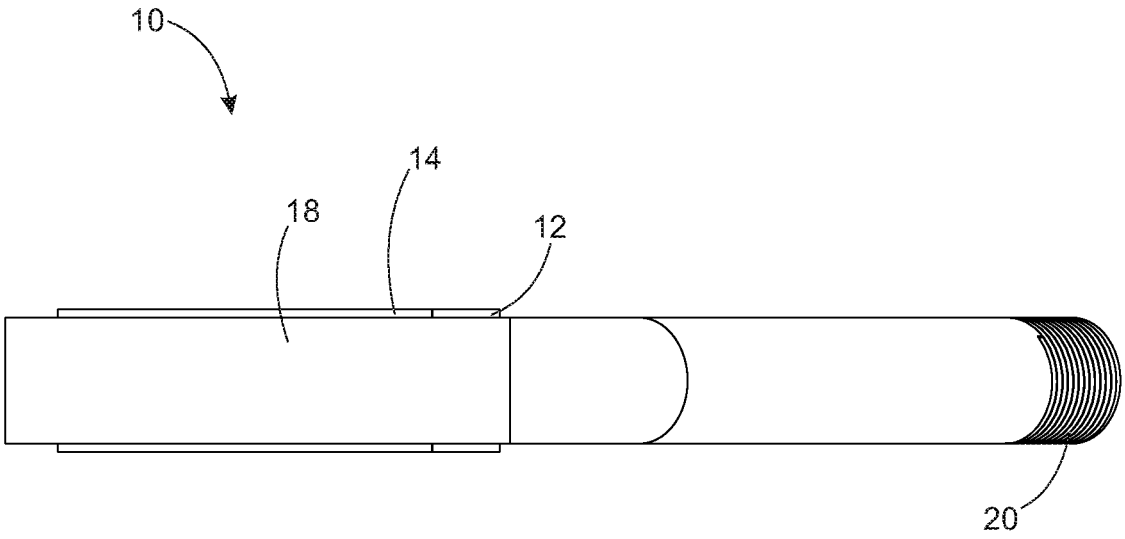
FIG. 3 is a top view of a sink drain clog removal device, according to an embodiment.
Figure 4:
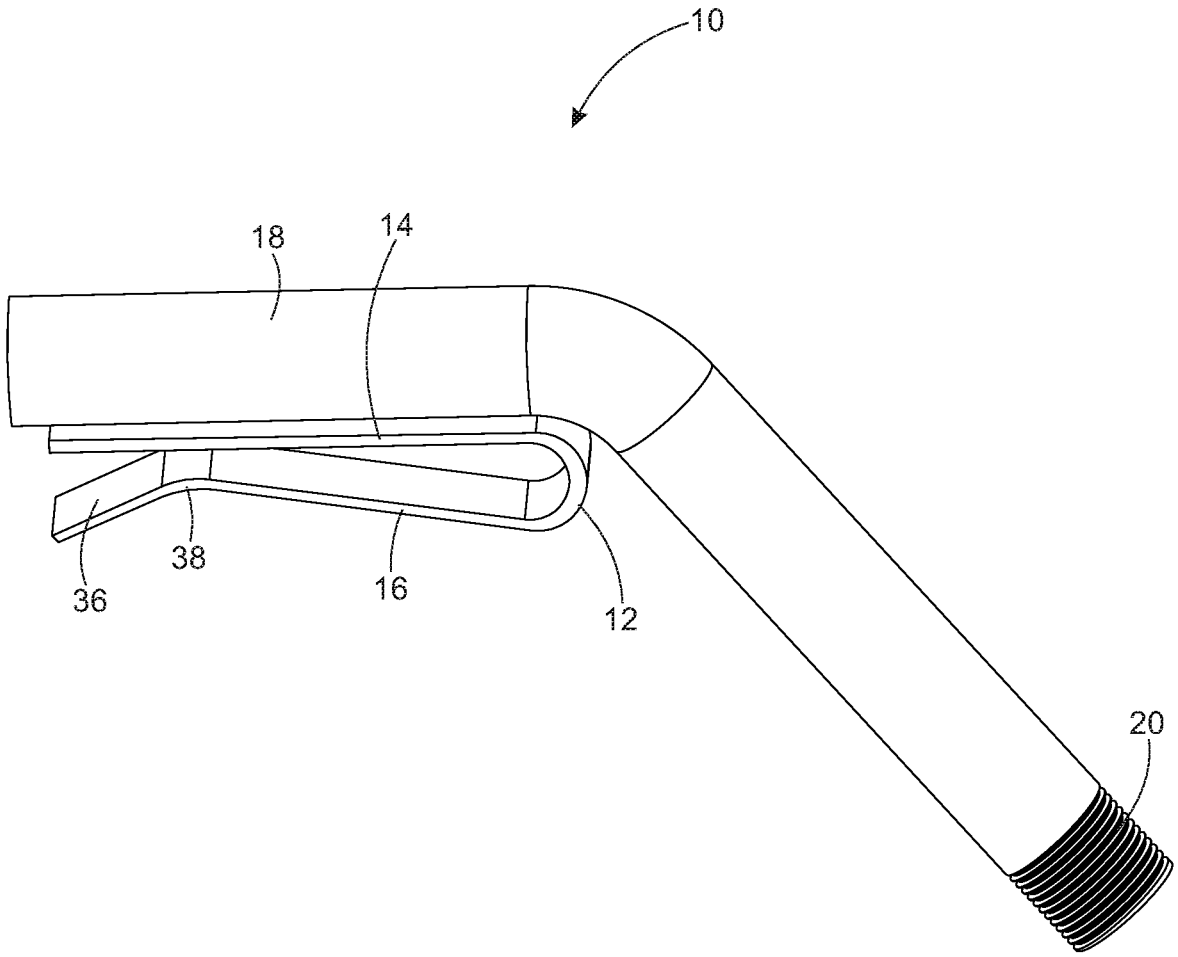
FIG. 4 is a front perspective view of a sink drain clog removal device, according to an alternative embodiment.

With further reference to FIGS. 2-4, the clamping member 12 may be generally U-shaped, having an upper arm 14 and a lower arm 16. The upper arm 14 is configured to be partially inserted into a sink drain pipe 30, as shown in FIG. 1, wherein clamping member 12 slides over the lip 32 of drain pipe 30, such that lower arm 16 remains outside of the drain pipe 30.

In the embodiment shown in FIGS. 1-3, the lower arm 16 further comprises a threaded clamping screw aperture 24 through which a clamping screw 22 is inserted to secure the clamping member 12 to the drain pipe 30 by tightening the clamping screw 22 against the drain pipe 30. As shown in FIGS. 1 and 2, the clamping screw 22 has a wing-type head, such as may be tightened by hand. However, this is not intended to be limiting. Clamping screw 22 may have any type of screw head known by a person of ordinary skill in the art, such as may be tightened by hand, by use of a screwdriver, or otherwise. Furthermore, in some embodiments, more than one clamping screw 22 may be utilized to secure clamping member 12 to the drain pipe 30.

As shown in FIG. 4, in some embodiments, clamping member 12 may be a unitary spring-loaded clip, wherein the lower arm 16 has a curved portion 36 extending away from the upper arm 14 to facilitate insertion of clamping member 12 over the lip 32 of a drain pipe 30, and the spring force of clamping member 12 tends to bias the lower arm 16 against the upper arm 14 at contact point 38. This embodiment of clamping member 12 may be removably coupled to a sink drain pipe 30 by simply sliding the clamping member 12 over the lip 32 of the drain pipe 30 such that the spring force of clamping member 12 biases the lower arm 16 toward the upper arm 14 and firmly against the drain pipe 30, such that the clamping member 12 is held in position by friction between the upper and lower arms 14 and 16 of clamping member 12 and the drain pipe 30 without the use of a clamping screw 22.

Referring to FIGS. 1-4, the nozzle 18 of sink drain clog removal device 10 is coupled to the device 10 such that water may be directed into the drain pipe 30 when the device 10 is coupled to drain pipe 30, as particularly shown in FIG. 1. In some embodiments, nozzle 18 may further comprise a hose connector 20 for connecting nozzle 18 to a water supply hose 26. For example, without limitation, hose connector 20 may be a ⅜" male threaded end for receiving a ⅜" female hose end of water supply hose 30. In some embodiments, hose 26 may be a water supply line that is coupled to a sink water supply shutoff valve 28 (also known as an angle stop). Shutoff valve 28 may be used to control the flow of water through the hose 26. However, this is not intended to be limiting. Hose connector 20 may be any suitable hose connector known now or in the future for connecting nozzle 18 to any hose of any size for directing water through the nozzle 18.

As shown in FIG. 1, the clamping member 12 and nozzle 18 assembly is sufficiently small as to not seal off the opening 31 of the sink drain pipe 30, thereby allowing a plumbing cable 34 to be inserted into a sink drain pipe 30, bypassing the clamping member 12 and nozzle 18 assembly, while the clamping member 12 and nozzle 18 assembly is coupled to the sink drain pipe 30, simultaneously. In some embodiments, the hose connector 20 may be angled away from the opening 31 of the sink drain pipe 30, so as to further avoid interference of the hose connector 20 with a plumbing cable 34 being inserted into the sink drain pipe 30. This angled feature also serves to keep hose 26 out of the way of a plumber's operation of the plumbing cable 34 when the hose connector 20 is coupled to hose 26. While the hose connector 20 is shown at an angle, it will be understood that the hose connector 20 can be located at any angle with respect to the clamping member 12 without deviating from the intended use of the present invention. Additionally, the hose connector 20 may be any type of hose connector so long as the hose connector directs water through the nozzle 18 and into the sink drain pipe 30.

The nozzle 18 is a tubular body that provides fluid communication through the entire length thereof for water to flow therethrough. When the hose connector 20 is coupled to a hose 26, and the hose 26 is further coupled to a water supply, water running through the hose 26 will flow through the nozzle 18 and be directed into the sink drain pipe 30. In operation, water is directed through the nozzle 18 and directed into the sink drain pipe 30 while a plumbing cable 34, inserted into the sink drain pipe 30, is being utilized to clear the blockage within the sink drain pipe 30, thereby helping to flush the loose blockage debris down the sink drain pipe 30 towards the sanitary sewer. Furthermore, water may be directed from the nozzle 18 toward the plumbing cable 34, within the sink drain pipe 30, to clean blockage debris off the plumbing cable 34 as plumbing cable 34 is being pulled out of the sink drain pipe 30 after the blockage is cleared. The plumbing cable 34 is thereby removed in a relatively clean state, thus eliminating the need for cleaning blockage debris from the plumbing cable 34 after it is removed from the sink drain pipe 30.

The shutoff valve 28 may be utilized by a plumber to control on and off of the water flow as well as how fast the water flows. Hose 26 may be coupled to the valve 28. In at least this way, the plumber may use the water source to the sink to direct water into the sink drain pipe 30. The valve 28 allows for the plumber to start, stop and control speed of water flow into the sink drain pipe 30. The device 10 as a whole allows for directing water into the sink drain pipe 30 without the use of a hand of the plumber, thereby allowing the plumber to utilize both hands to operate the plumbing cable 34. Additionally, the use of the valve 28 eliminates the need to run a long hose to an external water supply by allowing the plumber to use the water supply below the sink drain pipe 30.

Although a sink drain clog removal device 10, as described and as shown in the drawings, is supplied by water from the water supply valve 28 of the sink water supply line, this is not intended to be limiting. In some embodiments, a sink drain clog removal device 10 may be supplied with water from a bucket, or other water container, by use of a water pump, a gravity feed, or the like, rather than being supplied from the water supply valve 28 of the sink water supply line. In some embodiments, the water container may be the sink itself. In operation, the sink may be plugged and filled with water. A water pump may be utilized to pump water from the sink and through the hose 26.

It will be understood that while certain shapes of components are shown, the present invention is not limited to the shapes shown and described. Any shape of component is acceptable so long as it performs the intended function.

Figure 5:
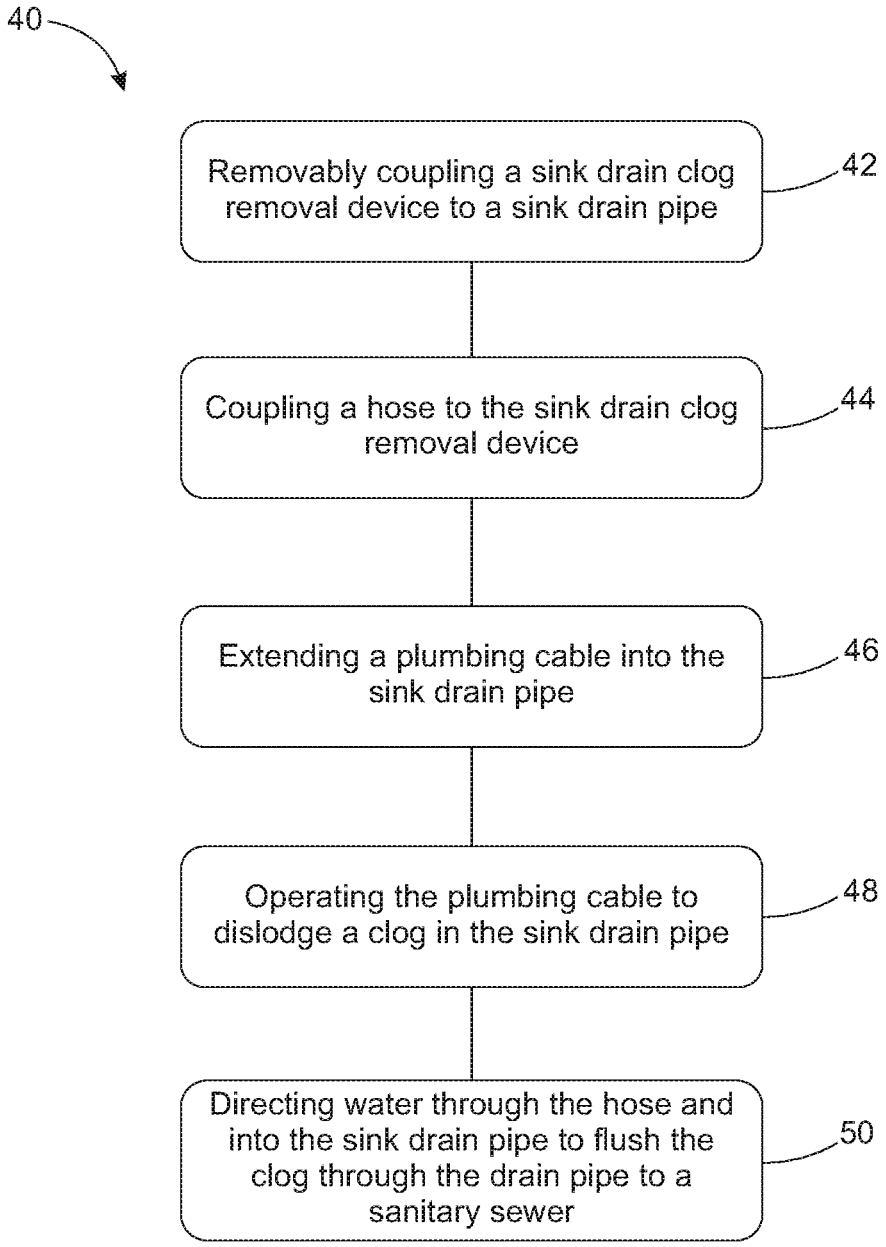
FIG. 5 is a flow chart of a method of unclogging a sink drain in accordance with embodiments of the present invention.

Referring again to the drawings, FIG. 5 depicts a flow chart showing a method 40 of unclogging a sink drain pipe. The method 40 may include removably coupling a sink drain clog removal device to a sink drain pipe (Step 42); coupling a hose to the sink drain clog removal device (Step 44); extending a plumbing cable into the sink drain pipe (Step 46); operating the plumbing cable to dislodge a clog in the sink drain pipe (Step 48); and directing water through the hose and into the sink drain pipe to flush the clog through the drain pipe to a sanitary sewer (Step 50).

In some embodiments of method 40, the sink drain clog removal device may comprise a clamping member configured to be coupled to a sink drain pipe, wherein the clamping member is U-shaped, having an upper arm and a lower arm; and a nozzle coupled to the clamping member, wherein the nozzle further comprises a hose connector configured to be coupled to a hose to direct water through the nozzle and into the sink drain pipe when the clamping member is coupled to the sink drain pipe.

In some embodiments of method 40, the sink drain clog removal device may be coupled to the sink drain pipe by tightening a clamping screw of the sink drain clog removal device against the sink drain pipe. In some embodiments, the clamping member may be a unitary spring-loaded clip, wherein a spring force of the spring-loaded clip biases the lower arm toward the upper arm, wherein the sink drain clog removal device is secured to the sink drain pipe by friction between the drain pipe and each of the lower arm and the upper arm.

The method 40 may include additional steps. Step 42 of removably coupling the hose to the sink drain clog removal device comprises removably coupling the hose to a hose connector of the sink drain clog removal device.

Method 40 may also comprise coupling the hose to a sink water supply shutoff valve. The method 40 may also comprise controlling water directed into the sink drain pipe by use of the sink water supply shutoff valve.

Method 40 may also include a step of disconnecting a sink from the sink drain pipe. Additionally, Step 50 of directing water through the hose into the sink drain pipe may further comprise cleaning the plumbing cable with the water. For example, the method 40 may include directing water from the spray nozzle to the plumbing cable while pulling the plumbing cable out of the sink drain pipe. This allows the plumbing cable to be cleaned from any clog buildup transferred to the plumbing cable during the unclogging process and keeps the plumbing cable from obtaining foul odors.

The components defining any sink clog removal device may be formed of any of many different types of materials or combinations thereof that can readily be formed into shaped objects provided that the components selected are consistent with the intended operation of a sink clog removal device. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any sink clog removal device may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A sink drain clog removal device comprising:

a U-shaped clamping member having an upper arm and a lower arm configured to releasably couple to a sink drain pipe;

a clamping screw extending through a threaded aperture in the lower arm, wherein the clamping member is secured to the sink drain pipe by tightening the clamping screw against an outer surface of the sink drain pipe; and a nozzle coupled directly to the upper arm of the u-shaped clamping member, wherein:

a portion of the nozzle and the upper arm extend into the sink drain pipe with a portion of the sink drain pipe extending between the upper arm and the lower arm when coupling the u-shaped clamp to the sink drain pipe;

the nozzle and u-shaped clamping member are sized to not seal off an opening of the sink drain pipe, thereby allowing a plumbing cable to be inserted into the sink drain pipe, bypassing the u-shaped clamping member and nozzle while the clamping member and the nozzle is coupled to the sink drain pipe; and the nozzle further comprises a hose connector configured to be coupled to a hose to direct water through the nozzle and into the sink drain pipe when the u-shaped clamping member is coupled to the sink drain pipe.

2. The device of claim 1, wherein the hose connector is angled away from an opening of the sink drain pipe.

3. The device of claim 1, further comprising a hose coupled to the hose connector.

4. The device of claim 3, further comprising a valve coupled to a water supply, the hose being coupled to the valve.

5. The device of claim 4, wherein the water supply is a sink water supply.

6. A sink drain clog removal device comprising:

a U-shaped clamping member having an upper arm and a lower arm configured to releasably couple to a sink drain pipe with a portion of the sink drain pipe extending between the upper arm and the lower arm, wherein the clamping member is spring loaded, wherein a spring force of the clamping member biases the lower arm against the upper arm, wherein the clamping member is securable to a sink drain pipe by friction between the clamping member and the sink drain pipe; and a nozzle coupled directly to the upper arm of the u-shaped clamping member, wherein:

a portion of the nozzle and the upper arm extend into the sink drain pipe with a portion of the sink drain pipe extending between the upper arm and the lower arm when coupling the u-shaped clamp to the sink drain pipe;

the nozzle and u-shaped clamping member are sized to not seal off an opening of the sink drain pipe, thereby allowing a plumbing cable to be inserted into the sink drain pipe, bypassing the u-shaped clamping member and nozzle while the clamping member and the nozzle is coupled to the sink drain pipe; and the nozzle further comprises a hose connector configured to be coupled to a hose to direct water through the nozzle and into the sink drain pipe when the u-shaped clamping member is coupled to the sink drain pipe.

7. The device of claim 6, wherein the hose connector is angled away from an opening of the sink drain pipe.

8. The device of claim 6, further comprising a hose coupled to the hose connector.

9. The device of claim 8, further comprising a valve coupled to a water supply, the hose being coupled to the valve.

10. The device of claim 9, wherein the water supply is a sink water supply.

* * * * *